US005937923A

United States Patent [19]

Bielagus et al.

[11] Patent Number: 5,937,923

[45] Date of Patent: Aug. 17, 1999

[54] CHIP SLICER

[75] Inventors: Joseph B. Bielagus, Tualatin; James R. Montgomery, Gresham, both of Oreg.

[73] Assignee: Beloit Technologies, Inc., Wilmington, Del.

[21] Appl. No.: 09/131,557

[22] Filed: Aug. 10, 1998

[51] Int. Cl.[6] ..... B27L 11/02; B27C 1/00; B02C 18/14

[52] U.S. Cl. ..... 144/172; 144/174; 144/241; 144/163; 241/32; 241/85

[58] Field of Search ..... 241/32, 85, 86, 241/92, 93, 95, 227, 228, 229, 294; 144/162.1, 163, 172, 173, 174, 176, 241

[56] References Cited

U.S. PATENT DOCUMENTS

| | | |
|---|---|---|
| 4,235,382 | 11/1980 | Smith . |
| 4,771,718 | 9/1988 | Carpenter et al. . |
| 4,796,818 | 1/1989 | Thoma . |
| 4,850,408 | 7/1989 | Carpenter et al. . |
| 4,858,834 | 8/1989 | Lanham . |
| 4,972,888 | 11/1990 | Dean . |
| 5,004,028 | 4/1991 | Adams et al. . |
| 5,029,626 | 7/1991 | Dean et al. . |
| 5,146,963 | 9/1992 | Carpenter et al. . |

OTHER PUBLICATIONS

"Rader Turbo–Cast™ 1800 Chip Slicer"—Rader Companies.

Key Knife®—"Returnable Chipper Knife System"—Commercial Knife, Inc.

*Primary Examiner*—W. Donald Bray

*Attorney, Agent, or Firm*—Lathrop & Clark LLP

[57] ABSTRACT

A chip slicer has pivotably mounted chip-forming knives located so that the knife edges are in a plane which passes through the axis of rotation of the knives, as well as through the axis of pivoting. Another improvement is to employ a knife which has a blade which is bent at an obtuse angle to form a first and a second leg. The first leg has a cutting edge and an upper surface which defines a chip path. The second leg is bent with respect to the first leg in the direction of rotation of the knife ring. The knives are mounted to the ring by clamping wedges which are bolted to the knife ring so that they overlie the second leg and so clamp the knife blade by the second leg to thereby substantially remove obstructions from the chip path. A further improvement has chip depth gauges which are positioned in front of the knife edges. The depth gauges have trailing edges in the direction of rotation which extend substantially parallel to the upper surface of the blades. Yet another improvement employs chip knives which are mounted beneath spring loaded knife clamps which can be loosened by partially unbolting, so the blades may be driven laterally through holes in the sides of the knife rings by replacement blades.

7 Claims, 4 Drawing Sheets

CHIP SLICER

FIELD OF THE INVENTION

This invention relates to wood chip conditioning apparatus in general, and to chip slicers in particular.

BACKGROUND OF THE INVENTION

Wood is a major source of fibers for paper production. The process of production of fibers from wood involves debarking raw logs. When high quality fibers are required, the logs must be reduced to chips for processing by cooking the wood fibers in a solution until the material holding the fibers together, lignin, is dissolved. In order to achieve rapid and uniform digestion by the cooking liqueur, the wood, after debarking, is passed through a log chipper which reduces the raw wood to chips.

The raw chips from the chipper contain many over-sized and grossly over-sized wood chips. In order to present chips of uniform thickness to the digesting liqueur, the over-sized and grossly over-sized chips are processed through a chip slicer which reduces the overall over-sized chips to chips of a uniform thickness.

A typical chip slicer has a housing with a fan-like rotor mounted inside. Chips are fed in at the hub of the rotor having radial anvil blades, and are thrown out against a rotating ring which supports a plurality knives located parallel to the axis of the rotation of the hub. The knife support ring rotates in the same direction as the hub, but not as rapidly, so that centrifugal force brings the chips out against the ring where the anvil blades sweep over the knives, forcing the over-sized chips against the knives, where they are cut or sliced to the required thickness.

Several problems exist with known chip slicers. One problem endemic to chip slicers is the undesirable production of fines and pins. Fines are wood particles so small as to contain no useful fiber; pins are wood particles containing some useful fiber, but of lower quality, so that the percentage of pins used to produce a paper pulp must be limited.

Another problem associated with existing slicers is the difficulty in adjusting the thickness of the chips produced. The normal solution requires the replacement of a gauge bar associated with each knife, and requires the unbolting, removal and replacement of the gauge bar to adjust chip thickness.

Yet another problem associated with known chip slicers is excessive wear on the knife holder clamps caused by abrasive movement of the chips and entrained dirt and sand over the clamp surfaces.

Yet another problem associated with known chip slicers is that the blades become dull and must be periodically replaced. The down-time associated with blade removal can be excessive in some cases.

What is needed is a chip slicer which produces fewer fines and pins, and which is readily adjustable to form chips of varying thicknesses. Also desirable are chips slicers with more rapid change-out of slicer knives.

SUMMARY OF THE INVENTION

The chip slicer of this invention employs one or more of four distinct improvements.

The first improvement involves pivotably mounting a drum segment to which the knives are clamped. The pivot point is located radially outward in a direction opposite that of the rotation of the knife ring and rotor. The drum segments which hold the knives have inside surfaces with a radius of curvature the same as, or greater than, the distance between the axis of rotation and the forward edge of the knives. The chip forming knives are located so that the knife edges are in a plane which passes near or through the axis of rotation of the knives, as well as through the axis of pivoting of the drum segments to which the knives are mounted.

The effect of this geometry is that as the knives pivot for small angles, the edges of the knives experience little radial movement. However, the edge of the drum segment which forms the depth gauge and which is spaced from the knife in the adjacent drum segment pivots rapidly outwardly, so that slight motion of the drum segment about the pivot point will control the depth of cut by the radial motion of the depth gauge. Additionally, the geometry provides a gradually increasing clearance between the rotor and the drum segment, for each drum segment.

The second improvement is to employ a knife which has a blade which is bent at an obtuse angle forming a first and a second leg. The first leg has a cutting edge and an upper surface which defines a chip path. The second leg is bent at an obtuse angle in the direction of rotation of the knife ring. The knives are clamped to the ring between supportive ring underlying portions and a clamping wedge which overlies the second leg. By clamping on the second leg, which is bent away from the chip path, obstructions in the chip path are substantially removed. The bent blade as disclosed herin can be used advantageously in other wood processing equipment, such as chippers, rechippers, waferizers, etc.

A third improvement involves employing chip depth gauges which are positioned in front of the knife edges. The depth gauges have trailing edges in the direction of rotation which extend substantially parallel to the upper surface of the blades.

Yet another improvement to chip slicers of this invention employs chip knives which are mounted beneath spring loaded knife clamps. Further, the knife rotor support rings have holes aligned with the ends of the knives. To replace the knives, the knife clamps can be loosened by partially unbolting, wherein the springs lift the clamp out of engagement with the blades so that they may be driven laterally through the holes in the sides of the knife rings by replacement blades.

It is a feature of the present invention to provide a chip slicer in which the chip thickness may be readily adjustable.

It is another feature of the present invention to provide a chip slicer which produces fewer fines and pins.

It is also feature of the present invention to provide a chip slicer which provides a relatively straight discharge path for the chips formed.

It is yet another advantage of the present invention to provide a chip slicer in which the blades may be replaced more readily.

Further objects, features, and advantages of the invention will be apparent from the following detailed description when taken in conjunction with the accompanying drawings.

DESCRIPTION OF THE PREFERRED EMBODIMENTS

Figure 1:
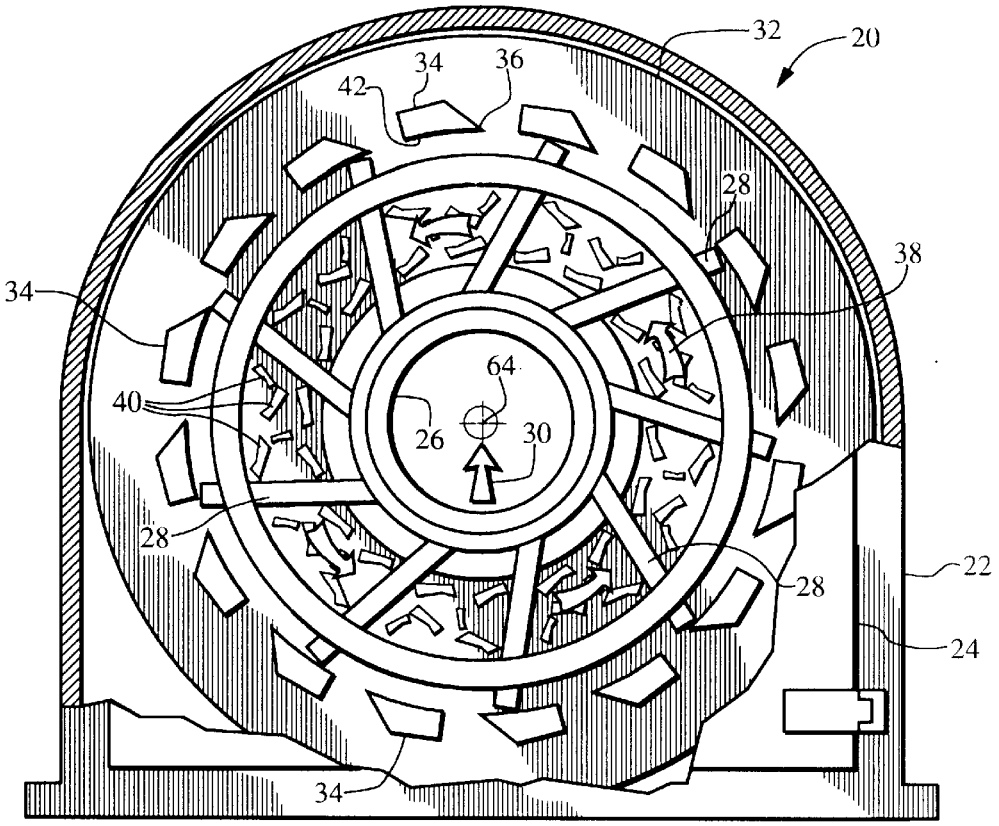
FIG. 1 is a front elevational view, partly cut away, of a chip slicer of this invention.

Referring more particularly to FIGS. 1–9, wherein like numbers refer to similar parts, a chip slicer 20 is shown in FIG. 1. The chip slicer has a housing 22. The housing has a front access door 24 on which is mounted an infeed chute (not shown) which supplies chips to the center of a rotor 26 which is rotatively mounted to the housing 22. The rotor 26 in the preferred embodiment is a cylindrical open frame which has nine anvils or paddles 28. The anvils 28 extend radially outwardly at an angle from the rotor hub. Chips 40 are supplied along the axis of the rotor 26 through the infeed chute as indicated by an arrow 30 to the center of the rotor 26. Surrounding the rotor 26 and mounted to the housing 22 to rotate coaxially with the rotor is a drum knife ring 32. Sixteen drum segments 34 are mounted to the knife ring 32. A chip knife 36 is mounted to each drum segment 34.

The rotor 26 and the knife ring 32 are driven by a gear train (not shown) and a motor (not shown) so that they both rotate in the same direction as shown by arrows 38. Although the rotor 26 and the knife ring 32 rotate coaxially, the ring is driven at between one-hundred and two-hundred RPM, wherein the rotor is driven at two-hundred-fifty to three-hundred-fifty RPM, with the difference in rotation rate being in the range of two-hundred to one-hundred-fifty RPM.

Figure 3:
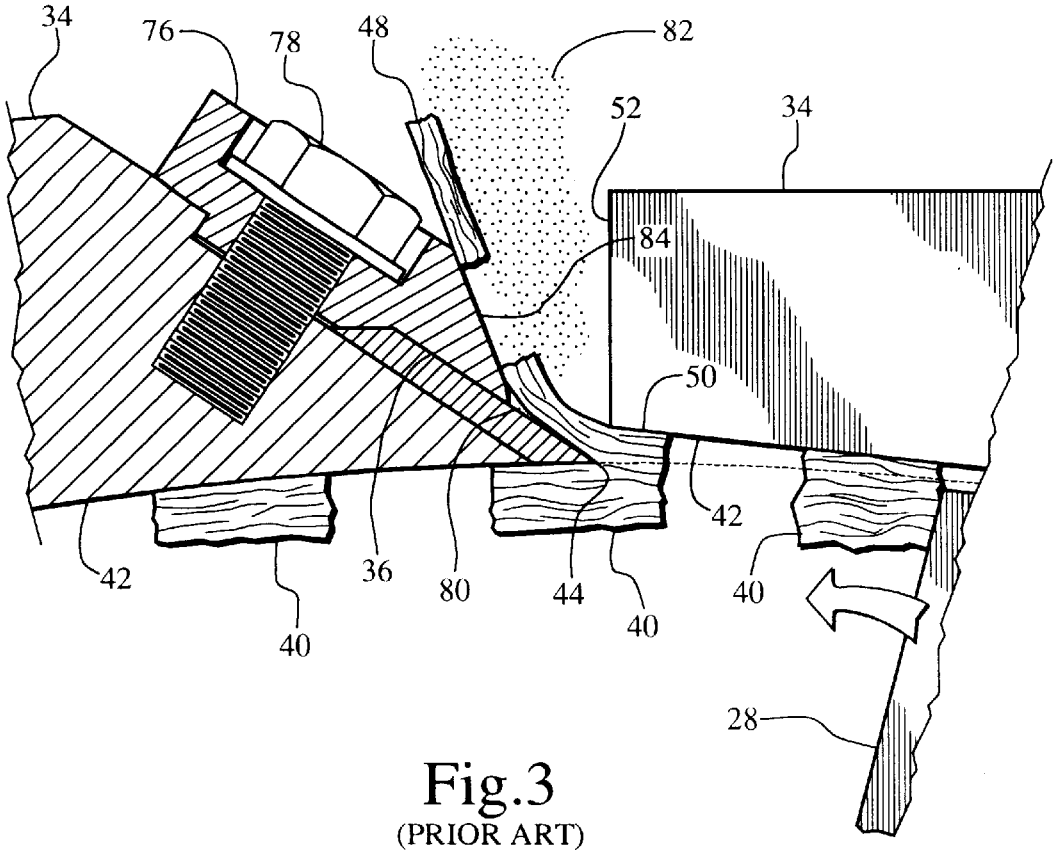
Fig.3 (PRIOR ART)
FIG. 3 is a somewhat schematic cross-sectional view of a prior art chip slicer knife-mount and clamp.

In operation, chips 40, as shown in FIG. 1 by arrow 30, flow in to the center of the rotor 26 and are accelerated radially outwardly by the rotor anvils 28, causing the chips 40 to move outwardly, where they lodge against an inside surface 42 of the drum segments 34, best shown in FIG. 3. The chips 40 are pushed by the rotor anvils 28 along the surface 42 until they hit the leading edge 44 of the knife 36, which shaves off a reduced thickness chip 48 which is then thrown away from the rotor 26.

The use of the combination of sixteen knives and nine anvils has been found to result in even wear on the drum knives 36 and the rotor anvils blades 28. The result of the odd number of anvils 28 and even number of knives 36 is that all the knives 36 and anvils 28 interact with each other. Further, the interaction between any anvil 28 and knife 36 takes place at a different orientation of the rotor 26 and knife ring 32, thus evening out the effects of gravity.

The thickness of the chips 40 is normally governed by a chip gauge 50 which forms the rear end 52 of the drum segment 34. In known chip slicers, the thickness of the chips may be changed by changing out a gauge block 54, best shown in FIG. 5. Changing out the gauge block 54 involves removing and replacing numerous bolts and gauge blocks.

The papermaking industry demands high capacity slicers and suppliers have responded by building wider units with longer knives, a greater number of knives and anvils, and higher rotational speeds. As a result of the difficulty in feeding high volumes of chips into wide cutting edge elements rotating at high speed, greater quantities of pin chips and wood fines are created, which are less desirable from a papermaking point of view. As wood fiber continues to become more valuable, the generation of this lower quality fiber becomes a real issue and decreasing its generation is an important goal.

In conventional slicers, the knife ring is about twenty-one inches to sixty inches in diameter with six to twenty knives located parallel to the axis of rotation. The knife ring is made up of segments which have radiused inside surfaces. The knife ring is a drum with a length or depth of twelve to twenty inches or more. The curved segments stop two to four inches prior to an opening at which point a surface which is flat and tangent to the knife drum inner diameter extends tangentially outward to a point just prior the knife which protrudes from the knife drum inner diameter to its outer diameter at an angle approximately thirty-two degrees from the tangent line, with the sharpened edge on the inside diameter.

The co-rotating rotor with an outer diameter slightly smaller than the drum ring inner diameter push chips along the curved knife drum segments with substantial material wedging into the clearance between the rotor and the drum segment inner diameter As the wood passes the end of the curved segment and enters the relatively short tangent piece, the wood must move outwardly in a very rapid manner to be in the proper position for slicing. If the pieces of wood are not completely in position or properly oriented, fines and pins are produced. Also, the piles of chips which occur in front of the anvils are a contributing factor to pin and fine production, due to disorientation of the wood chip against the drum segment. As the piled chips diminish, the centrifugal force of the mass of chips on chips being sliced diminishes, which has a detrimental effect, increasing fines and pin generation.

Power needed to drive the chip slicer is directly related to the number of cuts per minute. Experiments have shown that there is an optimum configuration having a certain number of knives and rotor anvils that will produce minimum fines and pins and maximum power consumption for a given feed rate. There will be a different number of knives and anvils, with more knives than anvils, with the knives and anvils so arranged that one knife and anvil will coincide at one time.

There are two things to be concerned about, that is the relative rotation between the anvil and knife for each successive interaction measured in degrees and the cutting capacity of a particular arrangement which is a function of the number of anvils times the number of knives, their differential speed and a loading factor. This loading factor is a variable, which depends on the arrangement. The relative speed of the co-rotating parts has developed from 150 RPM to 250 RPM with the knife ring running as slow as 100 RPM and the anvil at 350 RPM. For current designs, 350 RPM is a practical limit due to wood entrance limitations. If higher speeds are attempted, the wood chips tend to bind and capacity is limited and fines generation increases. If wider spacings between anvils are used, capacity is decreased unless knives are increased to compensate.

In previously employed chip slicers, the angle of the anvil to a radial reference line has ranged from ten degrees to thirty-five degrees. This angle provides good holding forces on the wood against the knife ring minimizing fines and pins without sacrificing wear life on the anvil wear bars.

Figure 2:
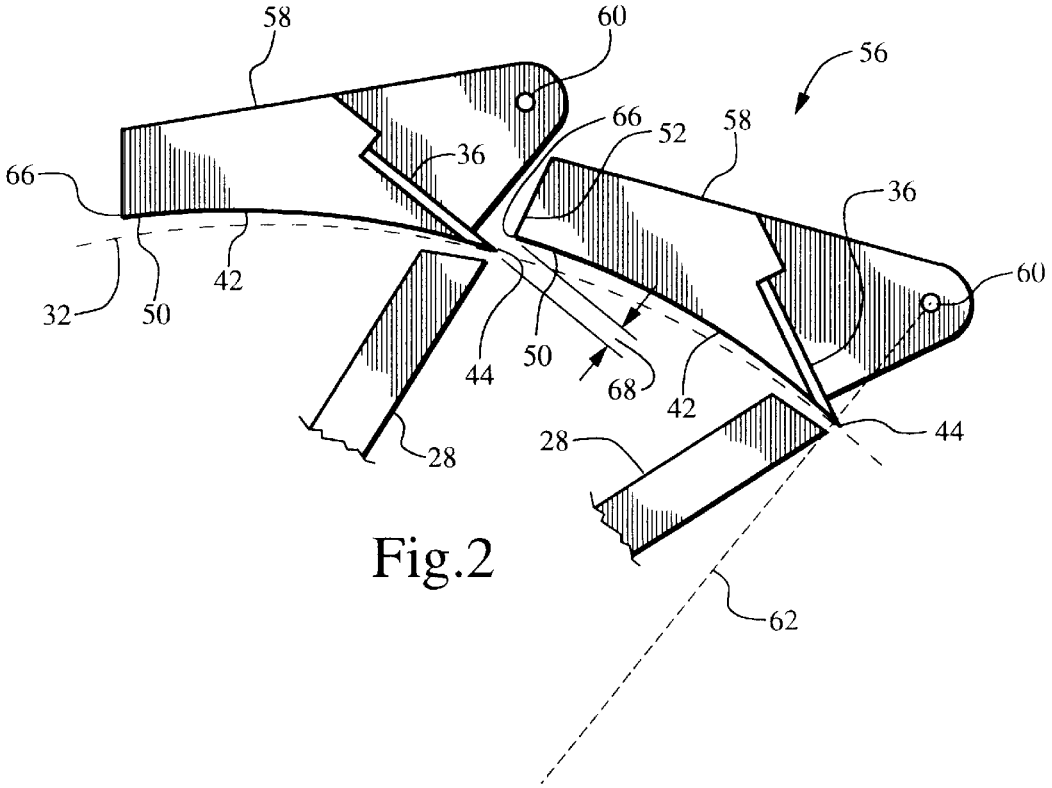
FIG. 2 is a fragmentary cross-sectional view of the adjustment means for the chip slicer of this invention.

FIG. 2 shows a portion of a chip slicer 56 of this invention in which the drum segments 58 are pivotably mounted about pivot points 60. A line 62 can be drawn through the pivot point 60, the knife blade edge 44, and the center of rotation 64 of the knife ring. The knife blade edge 44 cuts the chips 40 and is located so that its rotation with respect to the pivot point 60 is also tangent to the inside surface 42 of the knife ring 32. Because of this positioning, the knife blade edge 44 moves relatively little in a radial direction with small angles of rotation of the drum segment 58 about the pivot point 60.

The rear end 52 of the drum segment 58 includes a surface 50 which acts as the chip gauge and is located almost ninety degrees away from the line 62 between the pivot point and the center of rotation 64 of the ring knife 32. The result of this geometric arrangement is that for a small angle of rotation of the drum segment 58, the gauge surface 50 will move out radially many times as much as the radial movement of the blade edge 44.

Even greater ratios between the radial movement of the blade edge 44 and the gauge surface 50 could be achieved by placing the blade edge 44 a short distance in front of the line 62 between the pivot point and the center of rotation of the knife ring 32. Thus the blade edge 44 would move slightly inwardly as it approached the line 62 before again moving slightly outwardly with the rotation of the drum segment 58 about the pivot point 60. The disadvantage of this arrangement is that the slight inward movement of the blade edge 44 allows for the possibility of jamming or interfering with the rotor anvils 28, and thus will not be as desirable as the configuration shown in FIG. 2.

Another advantage to the moveable drum segment slicer 56 shown in FIG. 2 is that the knife ring inside surface 42 forms a gentle, continuous curve between the knife edge 44 and the gauge surface 50. The inwardly convex, arcuate surface 42 will typically have a radius of curvature equal to or somewhat greater than the distance between the knife edge 44 and the center of rotation of the knife ring 32. Because of the pivoting of the drum segment 58, the entire surface 42 from the knife edge 44 to the gauge surface 50 and the leading edge 66 is continuous over the entire range of chip thicknesses of the slicer 56. The continuous curve of the drum segments 58 will create a constantly relieving action which will minimize wedging of pins and fines between the anvil and drum inner diameter This gradual relieving will also present the wood more firmly against the knife drum inner diameter for cutting.

Between the moveable drum segments 58 are gaps or openings 68 through which the sliced chips pass. The motion of the anvils 28 which sweep chips across the knives 36 defines a trailing edge 66 on the rear end 52 of each drum segment 58. The motion of the anvils 28 also defines a trailing edge of the gap 68 which is the edge 44 of the knife 36. The drum segments 58 when adjusted to form chips 48 of the desired thickness are clamped against movement relative to the knife ring 32 by any suitable means such as a bolt and slot arrangement. For clarity, in FIG. 2 the clamping arrangement for the knives 36 is not shown.

Figure 6:
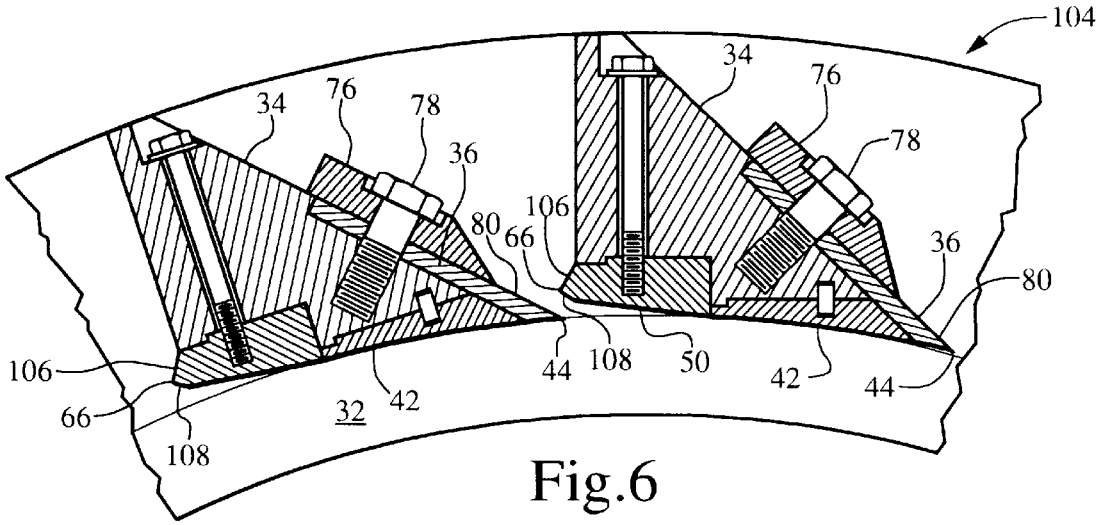
FIG. 6 is somewhat schematic cross-sectional view of the improved chip depth gauge of this invention.

It should be understood, however, that the trailing edge 66 may in some cases be extended behind and beyond the radial position of the leading edge 44, as for instance in the apparatus shown in FIG. 6.

Figure 4:
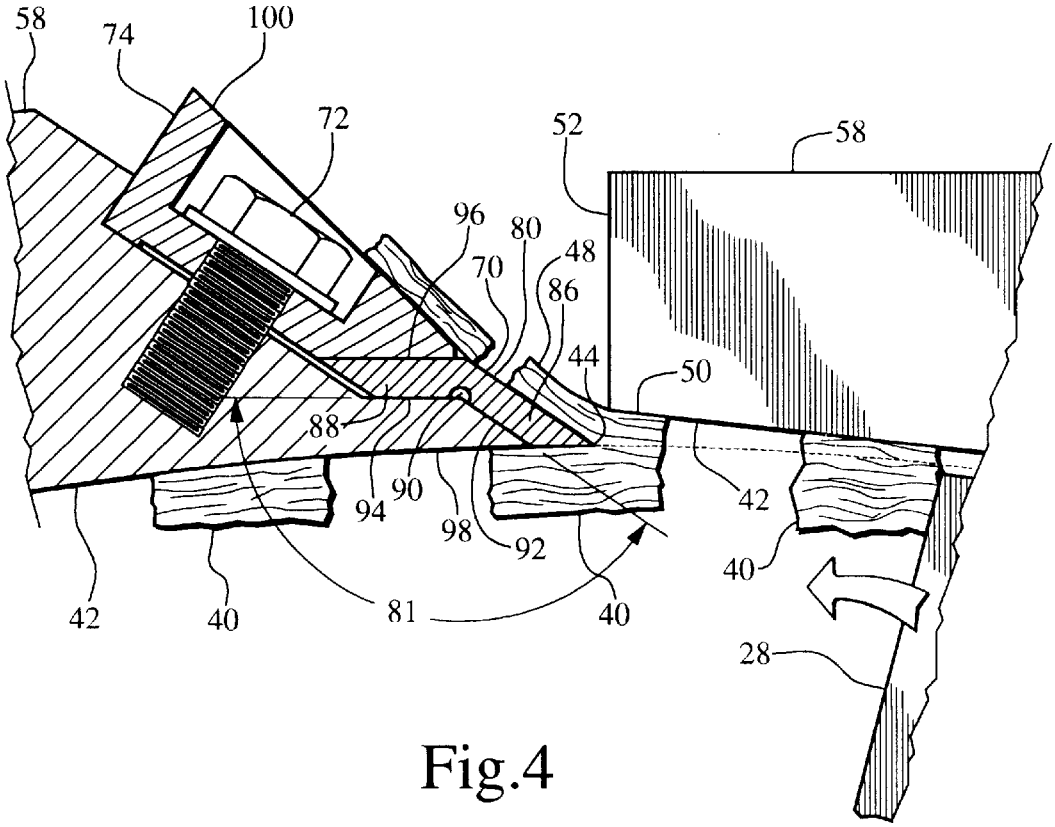
FIG. 4 is a somewhat schematic cross-sectional view of the improved chip knife and mount of this invention.

A preferred knife and clamp arrangement, as shown in FIG. 4, employs a bent knife 70 held to the knife ring by recess bolts 72 and a wedge 74. For a forty-eight-inch diameter slicer, knife rotor configuration is optimized at sixteen knives and nine anvils, with the angle of the paddles at an optimum holding angle of twenty-five degrees to a radial reference line. This combines the lowest pins and fines production with production rates to suit most mill screening demands. An optimal twenty knife, nine anvil arrangement is a good compromise for higher capacities with minimized fines generation. All these features combine to produce an optimum performance slicer.

A conventional knife 36 is shown in FIG. 3 which is held in a conventional knife clamp wedge 76 by a bolt 78. In the prior art device a chip slice 44 travels up the upper surface of the blade 36, where it impacts the knife clamp wedge 76, forcing the reduced thickness chip 48 to flex violently. This violent flexure of the chip 48 produces wood fines and pins 82 and produces excessive wear on the leading edge 84 of the knife clamp wedge 76.

A constant goal in papermaking is the reduction in production of fines and pins which contain no usable fiber and less-valuable fiber respectively. Because the cost of the wood fiber is a major constituent of paper manufacturing, destruction of wood fiber in the chipping process by the production of excessive fines and pins has a direct relation to the cost of paper production. (Even a fraction of one percent represents a substantial savings.) Further, to the extent that the periodic replacement of the knife clamps 76 increases downtime and maintenance costs, excessive wear of the wedges 76 is undesirable.

However, in addition to the added maintenance costs of the prior art assembly, is the introduction of yet another variable into the papermaking process. As the knife clamps wear, the chip slices 48 are treated to a slightly different processing as they impact the wedges. Though the wearing of the chip clamps 76 may or may not produce a detectable variation in the chip slices, elimination of this source of variability along with other small changes in the chip characteristic, forms a part of continuous efforts to increase the predictability and controllability of the papermaking process which can lead to significant improvements over time. Thus the removal of all sources of variability in the papermaking process is desirable, even if the source of variability is so slight that it does not by itself produce readily detectable variations.

The knife blade 70 of the present invention, shown in FIG. 4, overcomes these problems by bending the blade at an obtuse angle 81 to form two legs 86, 88. The second leg 88 is bent at an obtuse angle 81 with respect to the first leg 86. The first leg 86 extends generally radially inwardly at an angle to the radius line, and has portions which form the cutting edge 44 and the chip path 80. The inside corner of the obtuse angel 81 formed between the first leg 86 and second leg 88 can be manufactured with a relieved groove 90 to facilitate precision grinding of the bottom surface 92 of the first leg with respect to the bottom surface 94 of the second leg.

The blade 70 is manufactured of a grade of knife steel which normally must be finished by grinding. Grinding cannot produce a sharp internal corner, and further, to reduce stress concentrations, a sharp interior corner is undesirable. The wedge 74 is a metal block with a down-turned wedge surface 96 which engages against and clamps the second leg 88 between an outwardly extending portion 98 of the drum segment 58. The result of this arrangement is that the upper surface 100 of the wedge clamp 74 lies nearly in the same plane as the chip path surface 80 on the upper surface of the first leg 86.

Although the obtuse angle is shown at approximately one-hundred-twenty degrees, it could be varied about this value. As the obtuse angle approaches one-hundred-eighty degrees, the knife and clamping system begin to take on the disadvantages of the prior art shown in FIG. 3. On the other hand, as the obtuse angle approaches or exceeds 90 degrees, support of the knife 70 and the ring segment 58 becomes difficult. It should be noted that the knife blade 70 is reversible but need not be.

By manufacturing a bent knife as shown in FIG. 4, the knife wedge 74 can now hold and restrain the knife 70 on a surface 94 different from the surface 80 used to split and slice the wood chips 40. This allows the knife wedge 74 to be positioned behind the knife 70, out of the flow of wood chips 40, but also allows the knife wedge 74 to properly locate and secure the knife 70. With the knife wedge now located out of the chip flow, the chips 48 are allowed to freely exit the slicing area without impacting the wedge 74 and shattering into fines and pin chips.

Once one edge is worn, the knife 70 may be removed and reversed so that the second leg performs the functions attributed to the first leg above. The knives 70 or the knife wedge 74 may be one or multiple pieces to accommodate different knife lengths. The width of the two legs of the knife should be equal where the knife is reversible. The knife clamp holds the knife in place with a wedging action as opposed to perpendicular line of force created by the bolt 72. This wedging force ensures proper knife alignment during assembly.

Use of shim stock between the clamped second leg of 88 of the knife and its seat will allow adjustment of the knife projection inside the rotor after resharpening. Therefore, the same rotor could accommodate both a throwaway reversible knife, and a thinner, reusable knife that will allow a limited number of resharpenings and reversals accompanied by removal of shims. These shims would have shapes similar to the knife.

Figure 5:
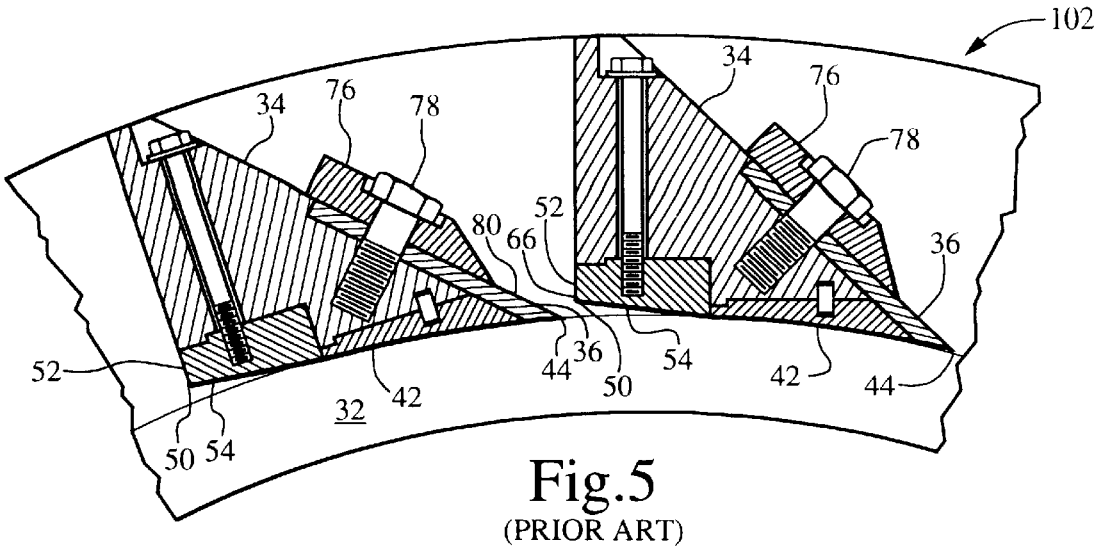
Fig.5 (PRIOR ART)
FIG. 5 is a somewhat schematic cross-sectional view of a prior art chip slicer chip depth gauge.

In the prior art chip slicer 102, shown in FIG. 5, each gauge inner surface 50 is part of a gauge block 54, which has a flat rear end surface 52 which extends substantially radially. The gap between the trailing edge 66 of the gauge block 54 and the blade edge 44 of the adjacent drum segment governs the width of the chip slice. Because the gauge surface 50 is not parallel to the chip path surface 80, the chip undergoes a sudden change of support as it passes through the gap between the edge 66 of the gauge block 54 and the knife edge, 44. This sudden change in support can fracture chips, producing excessive fines and pins.

The improved chip slicer 104 of the present invention employs gauge blocks 54 which have a rear end 106 which is pointed. The rear end 106 has an inwardly facing surface 108 which is parallel to or nearly parallel to the chip path surface 80 on the upper surface of the knife 36. The gauge block surface 108 extends upwardly from the inner surface 50. The improved geometry prevents the wood from turning as it is sliced, hence reducing fines generation, wear and horsepower requirements.

Figure 7:
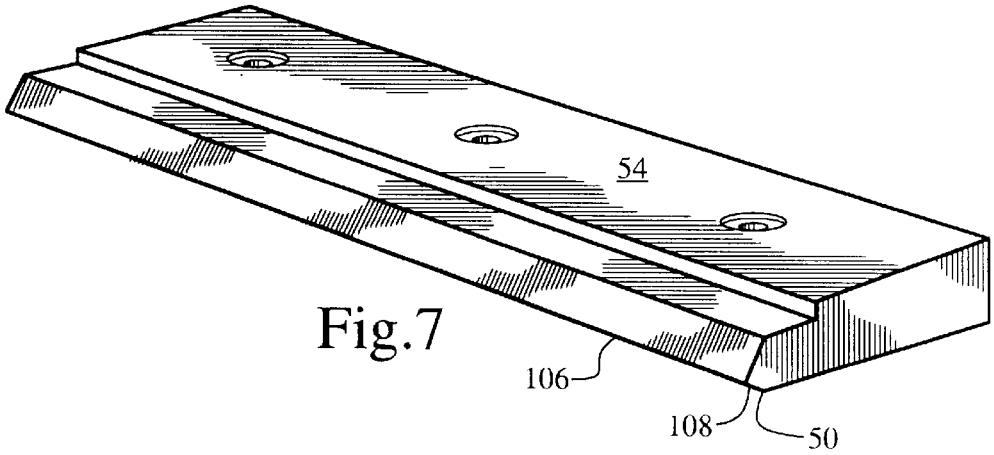
FIG. 7 is an isometric view of the chip gauge of this invention.

The width of the drum segments 34 and the knife ring 32 in general, as shown in FIG. 1, is on the order of twelve to twenty inches so that the gauge block 54 shown in FIG. 7 has a length of approximately twelve to twenty inches as well.

Figure 8:
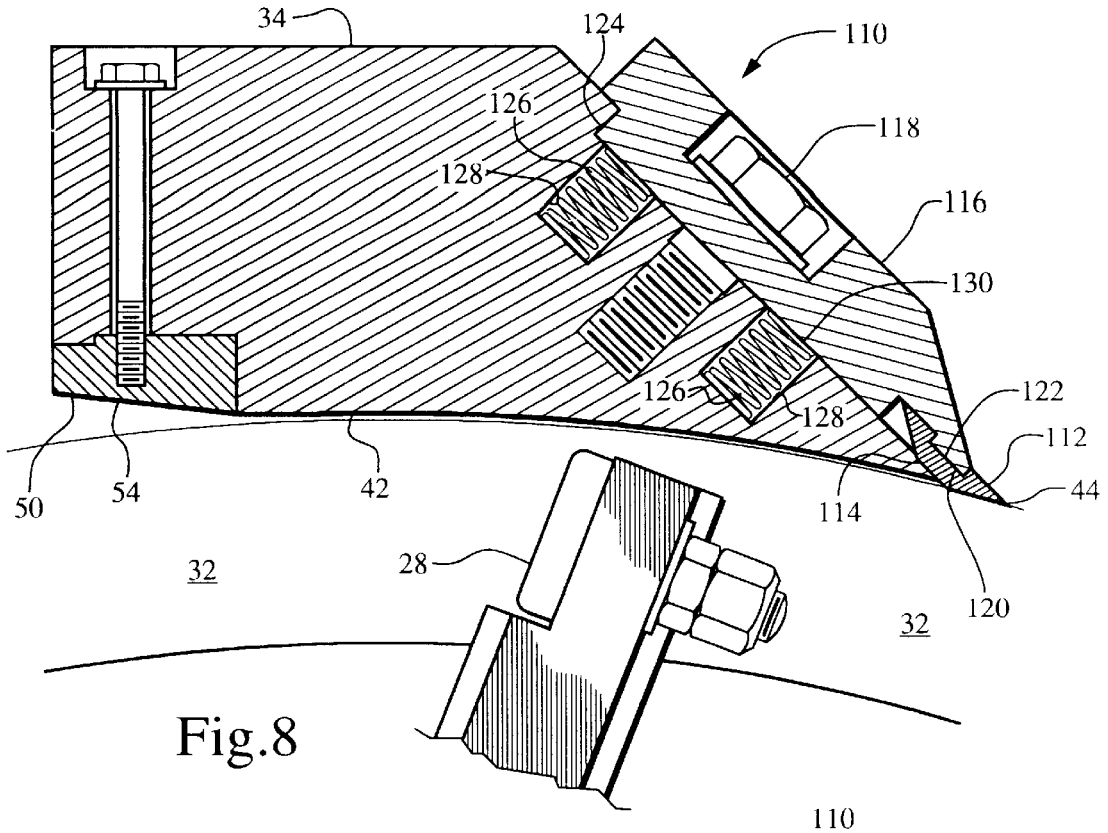
FIG. 8 is a somewhat schematic cross-sectional view of the improved chip slicer of this invention employing spring loaded blade clamps.
Figure 9:
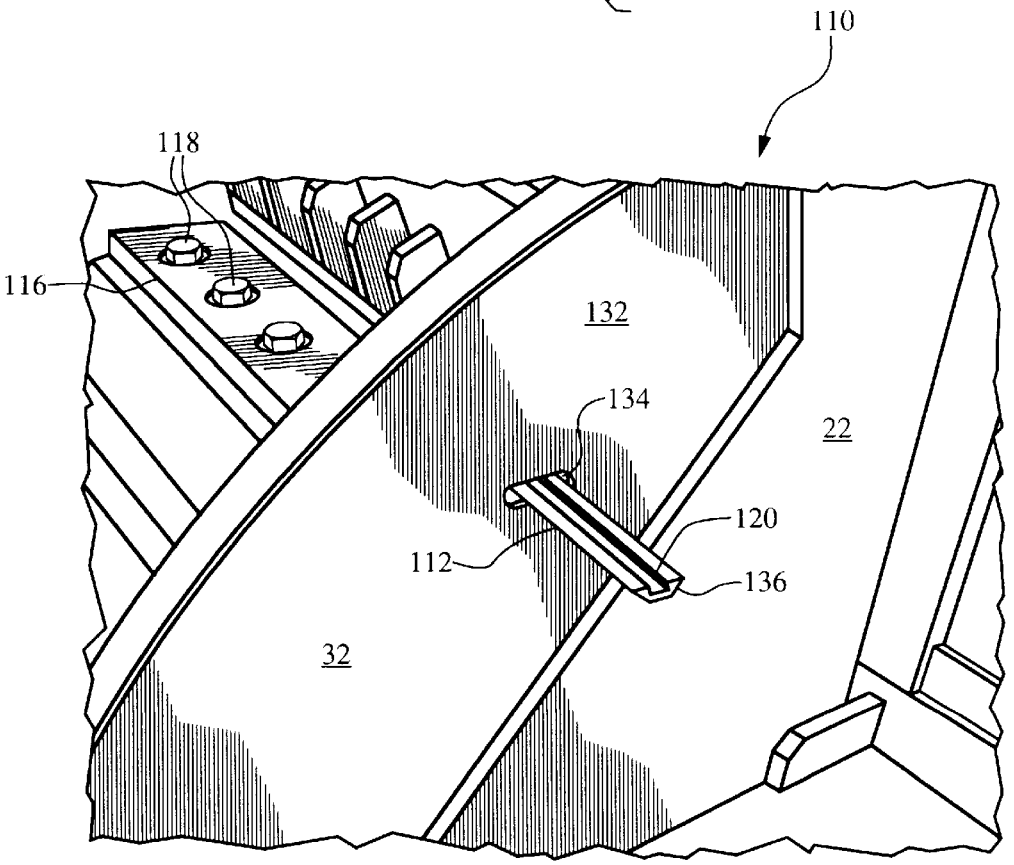
FIG. 9 is an isometric view of the apparatus of FIG. 8 showing the chip slicer knife being replaced through an opening in the slicer support blade.

Yet another problem associated with slicers 20 is that the knives 36 periodically become dull and must be replaced. Thus, it is desirable to replace the knives as rapidly and as efficiently as possible to minimize the cost associated with having the chip slicer down. As shown in FIGS. 8 and 9, the chip slicer 110 employs a narrow angular blade 112. A low profile clamp 116 engages and holds the blade 112 in a seat 114 which is machined in outer surface of the drum segment 34. The clamp is secured to the drum segment 34 by a bolt 118. The knife blade 112 has a recessed keyway 120 which interfits with a protruding key 122 formed by portions of the clamp 116.

The clamp 116 is positioned by a way 124, and the clamp 116 in turn positions the blade 112 and the blade cutting edge 44. The clamp 116 is biased outwardly by springs 126 disposed in spring holes 128 within the drum segment 34. When the bolt 118 is loosened, the springs 126 push against the lower surface 130 of the clamp to lift the clamp 116 a height less than the depth of the keyway 120. When the clamp 116 is lifted, the blade 112 remains captured by the keyway 120, the key 122, and the machined surface 114, but now may be slidably moved laterally as shown in FIG. 9 to be ejected from the drum segment 34.

The simple process of blade replacement is shown in FIG. 9. The knife drum segments 34 are attached to annular rings 132 which join thedrum segments 34 into the knife ring 32. The chip slicer 110 has portions of the lateral support rings which form holes 134 which are lined with the ends 136 of the blades 112. The blades 112 of the chip slicer 110 may readily be replaced by loosening the clamp bolts 118. The clamp 116, guided by the way 124, moves outwardly a slight distance until the blade 112 is no longer clamped, but remains captured between the machined surface 114 and the key 122 of the clamp 116.

A new replacement blade is then positioned opposite one end 136 of the blade 112 through the access holes 134 in the lateral support rings 132. Then, the knife blade 112 may be pushed out one side 132 of the knife ring 32 to be replaced by a replacement blade 112.

Resinous materials such as pitches and tars, depending on the wood species being processed, can build up about the blade 112, and may require periodic removal of the clamp 116 to effect a complete cleaning of the ring segment 34 and the surfaces surrounding the blade 112 and the clamp 116. The knife blade will preferably be symmetrical to permit reversing of the blades, thus extending time periods between sharpenings.

Use of knives which can be turned in slicers has increased in the past years because of convenience and time savings involved. By creating a secure mounting means for the keyed knife blade 112, the reversible knife is positively locked in location. The more accurately positioned knife results in consistent chip quality and this new clamping arrangement results in repeatability of blade 112 positioning.

It should be understood that the combination of nine anvils and sixteen knives shown in FIG. 1 could be employed with any of the chip slicers shown in FIGS. 2–9.

It should also be understood that the moveable segments of the chip slicer 56 of FIG. 2 could employ improved wedge clamps 74 as shown in FIG. 4, and improved knives 70.

It should also be understood that the chip slicer 56 of FIG. 2 could employ the invention of FIG. 6, having upwardly sloping surfaces which parallel the blade surfaces 36.

In general, it should be understood that each of the improvements shown and described in this invention could be combined with various other improvements to achieve the benefits or two or more of the disclosed chip slicer improvements.

It should also be understood the invention is not confined to the particular construction and arrangement of parts herein illustrated and described, but embraces such modified forms thereof as come within the scope of the following claims.

We claim:

1. A chip slicer for processing over sized wood chips comprising:

a housing;

a knife support ring rotatably mounted to the housing about an axis, wherein the ring has a first radially extending lateral support ring which is axially spaced from a second radially extending lateral support ring;

a plurality of knife mounts which face the axis and which are spaced circumferentially about the ring, wherein the mounts are fixed between the first lateral support ring and the second lateral support ring, and wherein each mount has a trailing edge and a leading edge and the trailing edge of one mount is spaced from the leading edge of a neighboring mount to define an opening;

a releasable clamp which overlies each knife mount;

a spring extending between each mount and an overlying clamp;

a knife having a cutting edge, wherein a knife is clamped to each mount by a clamp, and wherein each knife is positioned with respect to a mount such that the knife edge extends from the mount trailing edge into the opening;

portions of the support rings which define access holes axially aligned with each knife, wherein the holes are of a size to allow a knife to be extracted therethrough upon release of a clamp; and a rotor which receives chips introduced into the housing, wherein the rotor is rotatably mounted coaxial to the support ring and spaced within the support ring, and wherein the rotor has a plurality of anvil blades which define chip flow channels between blades which receive introduced chips, and wherein the anvil blades are closely spaced from the mounts for driving wood chips to be sliced along the mounts in a direction so the chips move across the openings from a mount leading edge to the a trailing edge so the chips are driven against the knife cutting edges and are thereby sliced.

2. The apparatus of claim 1 wherein the each knife has two parallel cutting edges which are spaced on either side of a recessed keyway, and wherein the knives are symmetrical such that a knife may be extracted through a hole, rotated and replaced to present one or the other of the cutting edges for cutting.

3. The apparatus of claim 2 wherein each clamp has a protruding key which extends into and engages with the knife keyway.

4. The apparatus of claim 1 wherein each clamp includes a bolt which is threadedly engaged with the mount, and wherein the springs are positioned within recesses in the mounts to bias the clamps away from the mounts.

5. The apparatus of claim 1 wherein sixteen knives are clamped to knife mounts on the knife support ring and wherein the rotor has nine anvil blades.

6. The apparatus of claim 1 wherein the knife support ring rotates at 100 to 200 RPM and the rotor rotates at 250 to 350 RPM.

7. The apparatus of claim 1 wherein the anvil blades are inclined at an angle of 10 to 35 degrees with respect to a reference radial line extending from the axis of rotation of the rotor.

* * * * *